United States Patent [19]

Roehrich

[11] 4,069,654

[45] Jan. 24, 1978

[54] CLEANING DEVICE FOR OPEN END SPINNING UNITS

[75] Inventor: Christian Roehrich, Chaillevette, France

[73] Assignee: Nuova San Giorgio S.p.A., Genoa-Sestry, Italy

[21] Appl. No.: 740,607

[22] Filed: Nov. 10, 1976

[30] Foreign Application Priority Data

Nov. 24, 1975 Switzerland ..... 15185/75

[51] Int. Cl.[2] ..... D01H 11/00; D01H 1/12

[52] U.S. Cl. ..... 57/56; 57/58.89

[58] Field of Search ..... 57/34 R, 56, 58.89–58.95, 57/34.5

[56] References Cited

U.S. PATENT DOCUMENTS

| | | | |
|---|---|---|---|
| 3,597,911 | 8/1971 | Schiltknecht | 57/56 |
| 3,760,577 | 9/1973 | Kihaka et al. | 57/58.89 X |
| 3,810,352 | 5/1974 | Miyazaki et al. | 57/58.95 X |
| 3,895,483 | 7/1975 | Grau | 57/56 |

*Primary Examiner*—John Petrakes

[57] ABSTRACT

Cleaning device for spinning units. According to the invention, the device is placed on a carriage movable along a set of spinning units. The device comprises a pressure fluid supply and a suction supply carried by the carriage. The pressure fluid supply is selectively connectable to a blowing nozzle opening internally of the chamber of each of the spinning units, whereas the suction supply is selectively connectable with a suction duct opening in the spinning chamber and containing a check valve, the opening of which is controlled by the depression or vacuum built up by the suction supply.

2 Claims, 3 Drawing Figures

2a
36a
35
8
9
10
11
37
36
7
7a
13
14
12
15b
24
32
16a
17
16
38

2
15a
23
26a
41a
40a
40b
39a
19
26
40
39
5
20
21
18a
18b
25
27
28
41
42
43
42a
1
27a
41b
22
2b
44
4
3
34
5
6
33
30
31

CLEANING DEVICE FOR OPEN END SPINNING UNITS

This invention relates to a cleaning device for a set of open end spinning units.

The break in a thread produced by an Open End spinning unit is due to the presence of impurities in the fibre ribbon, impurities that are thrown on the inner periphery of the spinning rotor along with the fibres. After every break, it is necessary that the rotor should be cleaned before thread re-attaching operation, in order to remove the causes of the thread break.

It is the common practice to carry out such a cleaning operation by means of a brush which is swept on the inner rotor periphery after opening of the rotor case.

Several solutions have been also proposed in order to automate such a cleaning operation. In one of these solutions it has been proposed that each of the spinning units should be associated with a pnenmatic cleaning device for blowing pressure air against the inner rotor periphery. Otherwise the case enclosing said rotor is connected to a suction supply. This solution suffers from the disavantage of requiring a cleaning device for each of the spinning units, thus involving a substantial investment when considering that a spinning frame generally has about one hundred spinning units on each side and thread break rate, substantially varying depending on the more or less cleanliness of ribbon, occurs in a spinning frame at a rate of about one break every three or four hours and one break every 30–40 hours for each of the spinning units. When taking into account such a break rate, the investment required for providing each of the spinning units with a cleaning device which at the most is to operate two or three times a day is extremely hard to amortize. Undoubtly, this is the reason why the above mentioned solutions have not yet had industrial application.

It is the object of the present invention to at least partly make up for the disadvantages of the above mentioned solutions.

Therefore, the present invention is directed to a cleaning device for the rotors of a set of open-end spinning units, each of which comprise a spinning chamber connected through two ducts with a pressure fluid supply, a respective suction supply, and a mechanism for rotor engagement with a driving member, in which each of said ducts comprise two distinct parts, of which one part is fixed with each of the spinning units and the other part is movable and carried by a carriage sliding along a guideway passing in front of each of said spinning unit. The duct parts of the carriage are movable between two positions, at one of which they are separated from the corresponding duct parts of said spinning units, and at the other position they are suited for selective connection to the corresponding duct parts of each of the spinning units, separately, said carriage comprising drive means for moving said movable duct parts from one to the other of said positions, and vice versa, and means for operating said mechanism to disconnect the rotor from said driving member.

The accompanying drawings diagrammatically show by way of example an enbodiment and a variant of the cleaning device according to the invention.

Figure 1:
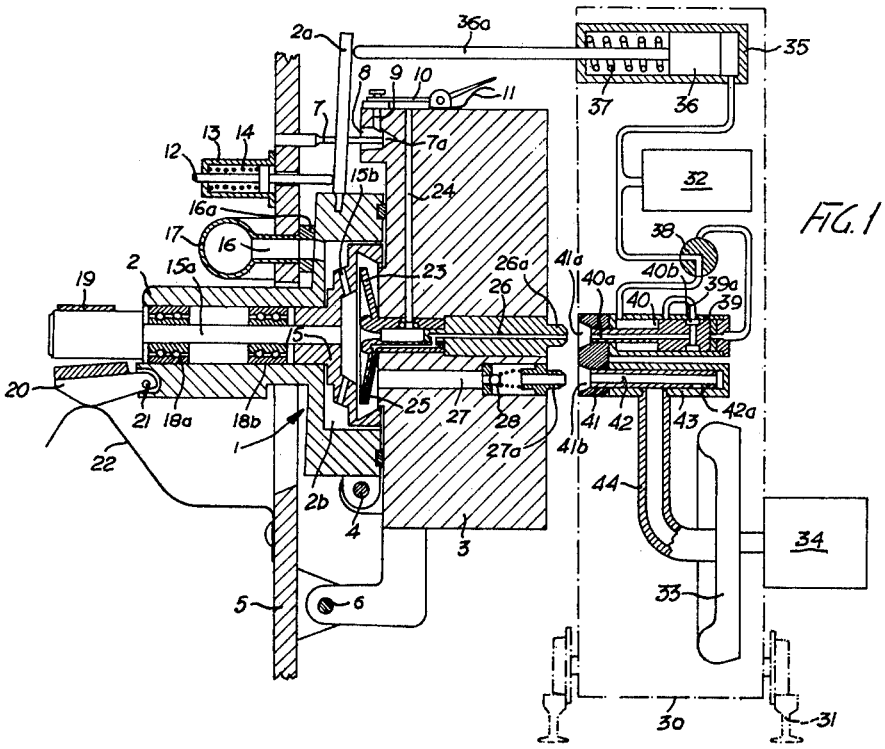
FIG. 1 is a sectional view showing a spinning unit and the cleaning device at rest or inoperative position.

FIG. 1 shows a spinning unit 1 comprising a case divided into two parts 2 and 3, these parts being linked to each other about an axis 4, and of which part 3 is in turn connected to the spinning frame 5 by means of a second linkage about an axis 6.

Said case part 3 has a second fastening point to frame 5, comprising a locking mechanism including a rod 7 fast with frame 5, which rod terminates with a tapered or conical tip **7*a*, the base diameter of which is larger than that of said rod 7. This rod 7 is intended for engagement in an aperture 8 of case part 3, sidewise penetrating therein the chamfered end of a latch 9 which is controlled by a lever 10 articulated in the case part 3 and biassed by a spring 11 constantly tending to hold said chamfered end of latch 9 in aperture 8. Fastening of case part 3 is provided by swinging movement about its associated pivot 6 against frame 5 until conical or tapered head 7*a* of said rod lifts the end of latch 9 which moves back to the position shown under the action of spring 11**.

First case part 2 is resiliently urged against second case part 3 by a stem 12 slidably mounted in a cylinder 13 and urged by a spring 14 against an arm **2*a* of said case part 2**.

This first case part 2 has a space **2*b* which is closed when case parts 2 and 3 are applied against each other. This space 2*b* is connected through a duct 16 to a manifold 17 with the interposition of a compressible member 16*a*. Said space 2*b* encloses a hollow rotor 15 defining a spinning chamber; rotor 15 has radial holes 15*b* and is rotably mounted in case part 2 by means of a shaft 15*a* which is journalled by ball bearing 18*a* and 18*b*. At the position shown in FIG. 1, said shaft 15*a* bears against the underside of a driving belt 19 which is common to all of the spinning units of a spinning frame. A braking shoe 20 is also articulated to a pivot 21 in case part 2 bearing against a spring 22**.

Case part 3 has a stationary separating disc or separator 23 concentrical with the axis of rotor 15, which separator 23 penetrates into the rotor and is axially bored for communicating said spinning chamber defined by rotor 15 with a thread withdrawing channel 24. This disc 23 is for guiding the fibres from the carding machine (not shown) into rotor 15 through a duct (not shown) in case part 3 opening behind disc 23 in a per se known manner, separating these fibres from the thread being withdrawn through the central opening of disc 23. Separator 23 carries one or a plurality of cleaning nozzles 25, only one of which is shown in the drawing, communicating with a connection duct 26 intended for connection to a pressure fluid supply, as described hereinafter.

Nozzle or nozzles 25 are orientated and converge to the annular fibre collecting surface in rotor 15 and can be radially directed or otherwise orientated with the most suitable angulation, as seen in a plane at right angles to the rotor axis. The arrangement of nozzle or nozzles 25 on the separator is convenient as affording for a better cleaning efficiency to move the pressure air blow outlet as close as possible to the fibre collecting surface, without adding any elements that could disturb the fluodynamic state and fibres in the rotor.

Duct 26 is provided coxially with separating disc 23 and forwardly of the spinning unit terminates with a connection projection 26*a* for engagement in the tapered or conical inlet 41*a* of a moving head 41, which inlet is suitably connected to a pressure fluid supply and carried by a carriage 30 to attend to a plurality of spinning units, as specified in the following.

Case part 3 has also a second exhaust or suction duct 27 located laterally of and parallel to the first duct. Similarly to the pressure fluid supply duct, this suction duct 27 opens at one end with an inlet to the spinning chamber of rotor 15, and at the other end terminates with a male connection defined by a projection 27*a* for engagement at cleaning step in a female connection or tapered inlet 41*b* of moving head 41. This inlet 41*b* is in turn connected to a suction supply. A normally closed valve 28, in this case a ball valve, is inserted in duct 27.

Up to now, there has been described a spinning unit resembling most of the prior art rotor spinning units, but essentially differing therefrom by comprising ducts 26 and 27 of the cleaning device, at one side opening to the spinning chamber of rotor 15 and outwardly opening at the other side, terminating with a connection for coupling with a corresponding connection carried by said moving head.

As mentioned above, the cleaning device is intended for attending a plurality of spinning units, in case even a plurality of spinning frames, and to this end comprises a movable part carried by a carriage 30 mounted on guide rails 31.

This carriage includes a pressure fluid supply comprising a compressor 32 and a suction supply comprising a fan 33 operated by a motor 34.

Compressor 32 is coupled to a first cylinder 35, the piston 36 of which is under the action of a return spring 37. This piston 36 extends outwardly of cylinder 35 by means of a stem 36*a*, having its end bearing against arm 2*a*. Said compressor 32 is also connected through a three-way valve 38 to a second double-acting cylinder 39 having a piston 40 sliding therein. The connection head 41 is secured to the tubular stem of said piston 40, projecting forwardly of cylinder 39. This connection head 41 has also integral therewith a tube 42 which is slidably pounted in a third cylinder 43 and communicating with said connection inlet 41*b*.

An axial channel 40*a* passes through piston 40, extends in stem and at one side communicates with an annular groove 40*b* of the piston, while communicating at the other side with said connection inlet 41*b*. Cylinder 39 also has a branch 39*a* intended for communicating duct 40*a* with the rear side of piston 40, and hence with compressor 32 at the position shown in FIG. 2. Said tube 42 has a side opening 42*a* intended to coincide or register with a conduit 44, at the position shown in FIG. 2, connecting cylinder 43 with said fan 33.

Said connection head 41 driven by piston 40 has its two tapered or conical inlets 41*a* and 41*b* respectively communicating with said axial channel 40*a* of piston 40 and inside of tube 42. Said inlets 41*a* and 41*b* are intended for coupling respectively with connections 26*a* and 27*a* projecting from case part 3 coaxially with said connection ducts 26 and 27, respectively.

Rotor 15 can be cleaned either at the time of thread break, or periodically in order to assure the production or output of a good quality thread owing to rotor cleaning at a higher rate than average thread break rate.

In both cases, the fibre supply to rotor 15 is initially shut off, which operation is generally automatically carried out by a thread break detector. Carriage 30 is then brought in front of that spinning unit, the rotor of which has to be cleaned.

Figure 2:
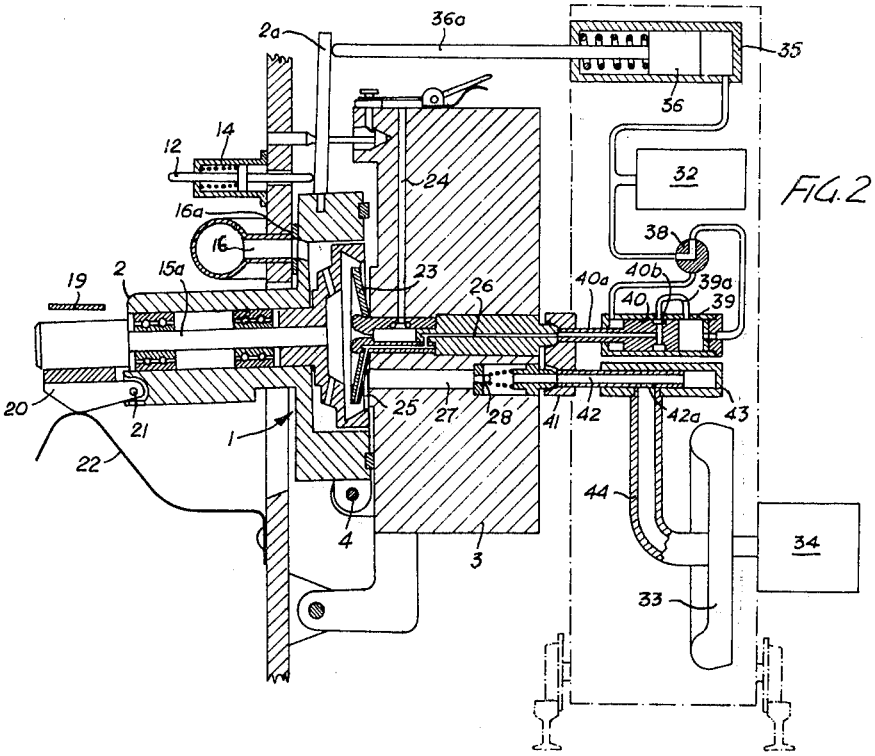
FIG. 2 is a view identical to that of FIG. 1, but showing the device at cleaning or operative position.

First, the compressor 32 supplies cylinder 35 with compressed air to forwardly urge or push piston 36 to the position shown in FIG. 2, at which stem 36*a* of piston 36 pushes arm 2*a* of case part 2 to said frame 5, overcoming the pressure exerted by spring 14 on stem 12. Case part 2 is swung to the position shown in FIG. 2, compressing said member 16*a* and releasing shaft 15*a* from belt 19 to apply it against said braking shoe 20 bearing against spring 22.

Then, through said three-way valve 38, compressor 32 will supply the rear end of cylinder 39, urging piston 40 towards the spinning unit and accordingly feeding said connection head 41 drawing in turn said tube 42. When the inlets 41*a* and 41*b* of head 41 are applied to connections 26*a* and 27*a*, the annular groove 40*b* of piston 40 is in front of the outlet of the branching conduit 39*a* (FIG. 2), so that the compressed air will supply said conduit 40*a*, connection duct 26 and nozzle 25. Said nozzle can be configurated to direct the air jet in a direction forming an angle with the plane perpendicular to the axis of rotor 15 and passing by the outlet end of nozzle 25, so as to turn the air against the inner surface of rotor 15. The air could also be made to exit through a number of angularly arranged nozzles. Finally, as a variant, it would be possible to dispense with the pressure of braking shoe 20 on shaft 15*a*, so that the air would rotate said rotor 15. At the same time, opening 42*a* of tube 42 is located in front of duct 44 and the fan is rotated by motor 34. The depression or vacuum thus built up, will open valve 28 and suck the impurities separated by the air jet of nozzle or nozzles 25.

Upon completion of the cleaning operation, supply to cylinder 35 is shut off, so that piston 36 is returned by spring 37. Fan 33 is stopped, allowing valve 28 to be closed again; the position of three-way valve 38 is inverted for communicating the compressor with the front end of cylinder 39, in order to bring piston 40 back to the position shown in FIG. 2, separating head 41 from connections 26*a* and 27*a*. Carriage 30 can then move in front of another spinning unit to be cleaned.

It is to be understood that the sequence of operations as above described can be programmed and entirely automatically carried out.

Figure 3:
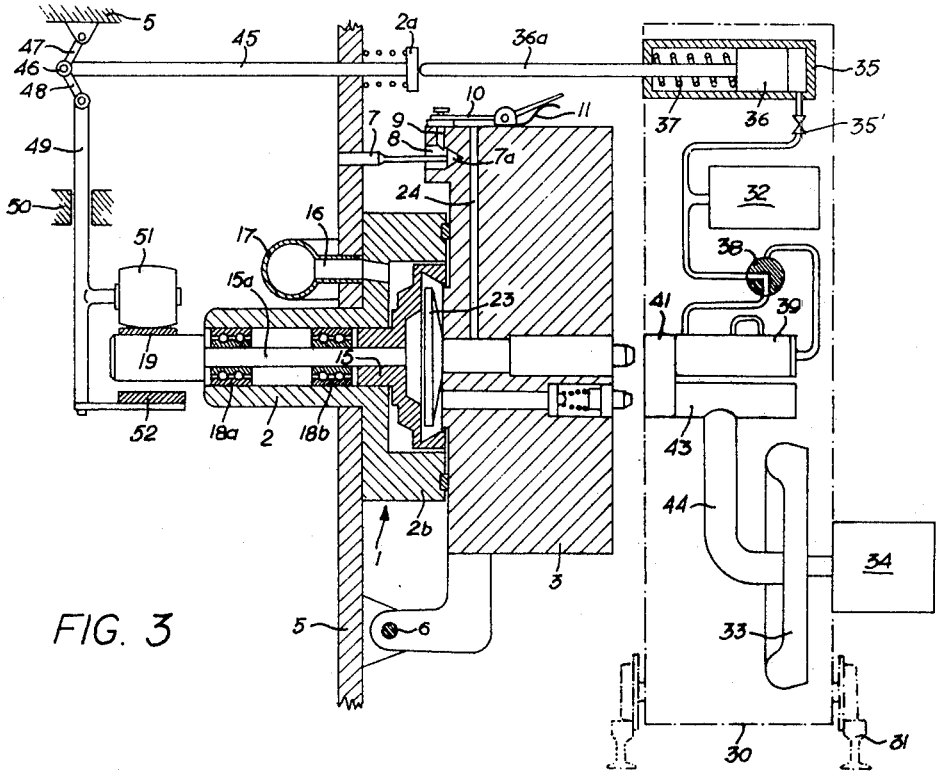
FIG. 3 is a view similar to that of FIG. 1, showing a further embodiment.

FIG. 3 illustrates a variant of the spinning unit that can be cleaned by means of the same device above described. The essential difference between the spinning unit shown in FIGS. 1 and 2 and that shown in FIG. 3 is that the case part 2 of the spinning unit is attached to frame 5 and not articulated to case part 3, as in the former case. Accordingly, instead of case part 2 to pivote in order to separate shaft 15*a* from belt 19 and apply it against brake 20, as shown in FIG. 2, stem 36*a* of piston 36 acts upon the head of a rod 45, the end of which opposite to said head is articulated to a hinge 46, connecting two arms 47 and 48. Arm 47 is articulated on frame 5, whereas arm 48 is articulated to a slider 49. This slider is guided by a bearing 50 and carries a pressure roller 51 and a braking shoe 52. Pressure roller 51 serves the purpose of engaging driving belt 19 with shaft 15*a* of rotor 15, which belt is normally separated from the shaft.

At the time of cleaning, stopping of rotor 15 is controlled by pushing stem 36 to the left, as seen in FIG. 3. Rod 45 provides for leftward moving hinge 46, so that the angle between arms 47 and 48 is reduced, causing an upward movement of slider 49, releasing said belt 19 and applying said braking shoe 52 against shaft 15*a*. During cleaning operation of rotor 15, it would be possible to impart a fast reciprocating motion to stem 36*a*, for example by periodically shutting off the pressure fluid supply by a valve 35', so as gradually bring the periphery of rotor 15 in front of nozzle 25. Under all of its aspects, the remainder of the operation is identical to that as formerly described.

What is claimed is:

1. A cleaning device for a set of open end type of spinning units each of which includes a rotor having a fiber collecting surface, said cleaning device comprising at least one blowing nozzle associated with each spinning unit located adjacent the fibre collecting surface of the rotor and a pressure fluid supply, a first duct means for connecting said pressure fluid supply to the blowing nozzle; a suction inlet located in front of the rotor, a suction supply, and a second duct means for connecting said suction supply to said suction inlet; carriage means moveable along said spinning units, said carriage means carrying said pressure fluid supply and said suction supply; each of said first and second duct means including a duct portion fixed to a respective spinning unit and a duct portion moveably supported by said carriage means and connectable with a respective duct portion fixed to a spinning unit; control means for connecting the duct portions carried by said carriage with the respective duct portions fixed to a selected spinning unit; a duct portion fixed to a respective spinning unit and forming part of said second duct means including a check valve, the opening of which is controlled by vacuum built up by said suction supply when the duct portion is interconnected with the associated duct portion on said carriage means.

2. A cleaning device as defined in claim 1 wherein the spinning units each include a separating disc disposed within a portion of the rotor, said at least one blowing nozzle associated with each of the spinning units being disposed on the separating disc of the spinning unit.

* * * * *